US010589823B1

(12) United States Patent
Fenech et al.

(10) Patent No.: US 10,589,823 B1
(45) Date of Patent: Mar. 17, 2020

(54) PONTOON BOAT

(71) Applicant: BARLETTA BOAT COMPANY, LLC, Bristol, IN (US)

(72) Inventors: William Fenech, Elkhart, IN (US); Mark Neibert, Millersburg, IN (US)

(73) Assignee: BARLETTA BOAT COMPANY, LLC, Bristol, IN (US)

( * ) Notice: Subject to any disclaimer, the term of this patent is extended or adjusted under 35 U.S.C. 154(b) by 0 days.

(21) Appl. No.: 16/141,949

(22) Filed: Sep. 25, 2018

(51) Int. Cl.
*B63B 1/12* (2006.01)
*B63B 3/32* (2006.01)
*B63B 3/14* (2006.01)

(52) U.S. Cl.
CPC ..... *B63B 1/121* (2013.01); *B63B 1/125* (2013.01); *B63B 3/32* (2013.01); *B63B 2001/123* (2013.01); *B63B 2003/145* (2013.01)

(58) Field of Classification Search
CPC ..... B63B 1/121; B63B 1/125
See application file for complete search history.

(56) References Cited

U.S. PATENT DOCUMENTS 3,370,309 A * 2/1968 Fredelake ..... B60F 3/0092 114/344
3,601,077 A * 8/1971 Valenza ..... B63B 1/14 114/61.15
3,877,094 A * 4/1975 Kelley ..... B60F 3/0092 114/344
4,295,236 A * 10/1981 Upchurch ..... B63B 1/121 114/357
4,998,497 A * 3/1991 Nelson ..... B63B 21/00 114/230.19
6,067,925 A * 5/2000 Little ..... B63B 1/125 114/354
7,950,340 B1 * 5/2011 Curtis ..... B63B 1/20 114/61.1
9,156,526 B2 * 10/2015 Handley ..... B63B 35/34
2009/0293790 A1 * 12/2009 Bogard ..... B63B 1/20 114/61.2
2012/0061893 A1 * 3/2012 Hochberg ..... F03G 7/08 267/195
2018/0099726 A1 * 4/2018 Broadway ..... B63B 7/04
2018/0304968 A1 * 10/2018 Minor ..... B63B 1/242

* cited by examiner

*Primary Examiner* — S. Joseph Morano
*Assistant Examiner* — Jovon E Hayes
(74) *Attorney, Agent, or Firm* — Barnes & Thornburg LLP

(57) ABSTRACT

A pontoon boat includes port and starboard pontoons and cross members connecting the pontoons. A shock absorber may be installed at each point of connection of the pontoons to the cross members. A cross member may be embodied as a double-webbed beam having first and second parallel flanges and first and second webs disposed between and connected to the flanges. Each pontoon may include a two-stage lifting strake having a first surface and a second surface inclined from the first surface.

21 Claims, 11 Drawing Sheets

PONTOON BOAT

BACKGROUND AND SUMMARY OF THE DISCLOSURE

Pontoon boats are known in the art. A conventional pontoon boat typically includes two or three pontoons interconnected by a plurality of cross members, deck boards connected to the upper side of the cross members, and railings, furniture and an operator's station disposed upon the deck boards.

Conventional pontoon boats tend to flex torsionally and to corner flat with respect to the surface of the water in which they are used. Both of these characteristics can be disconcerting to passengers thereon. Also, the ride of a conventional pontoon boat can be harsh.

DETAILED DESCRIPTION OF THE DRAWINGS

Figure 1:
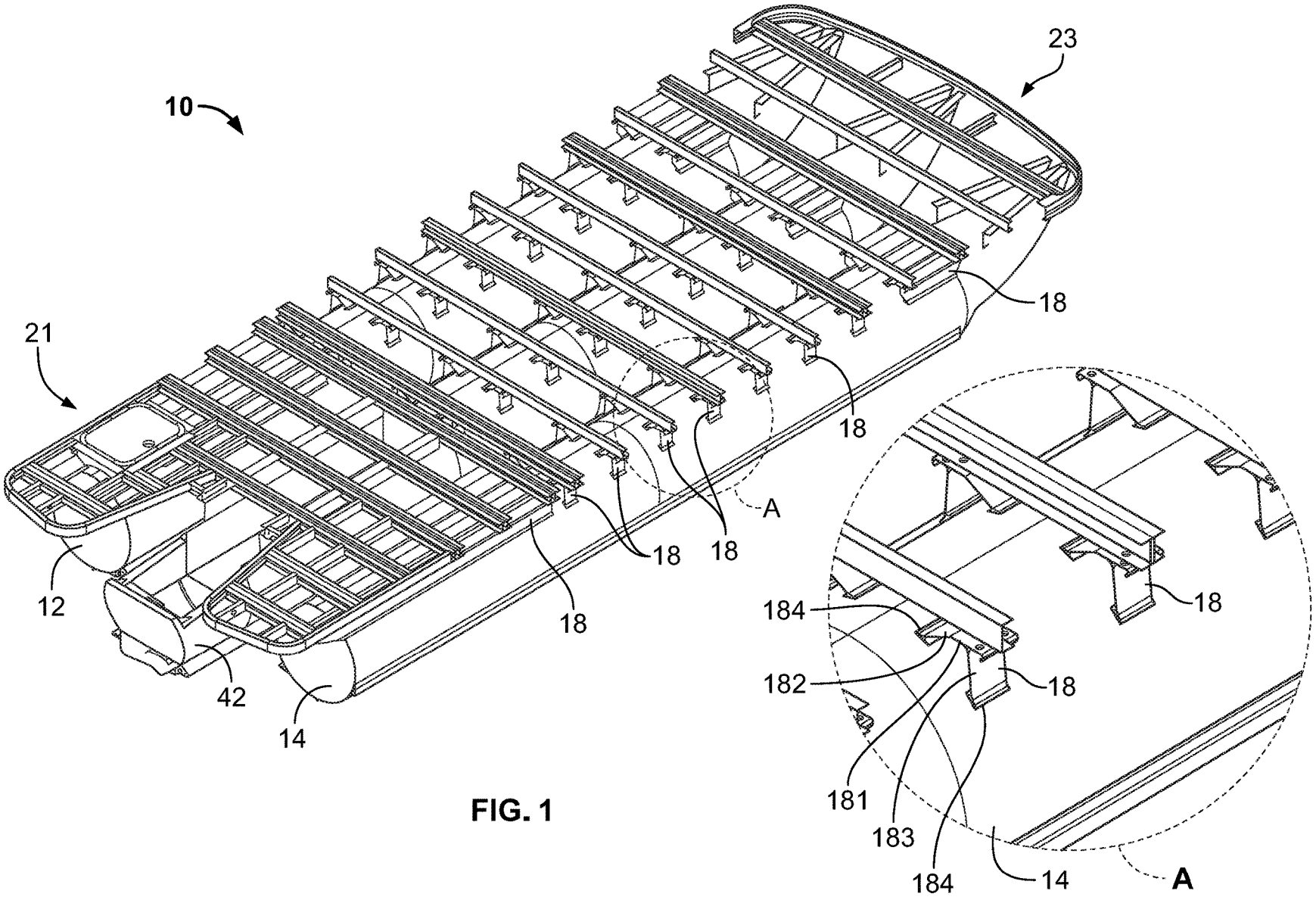
FIG. 1 is a perspective view of a portion of an illustrative pontoon boat according to the present disclosure including pontoons, lifting strakes, cross members, and a rear frame thereof.
Figure 2:
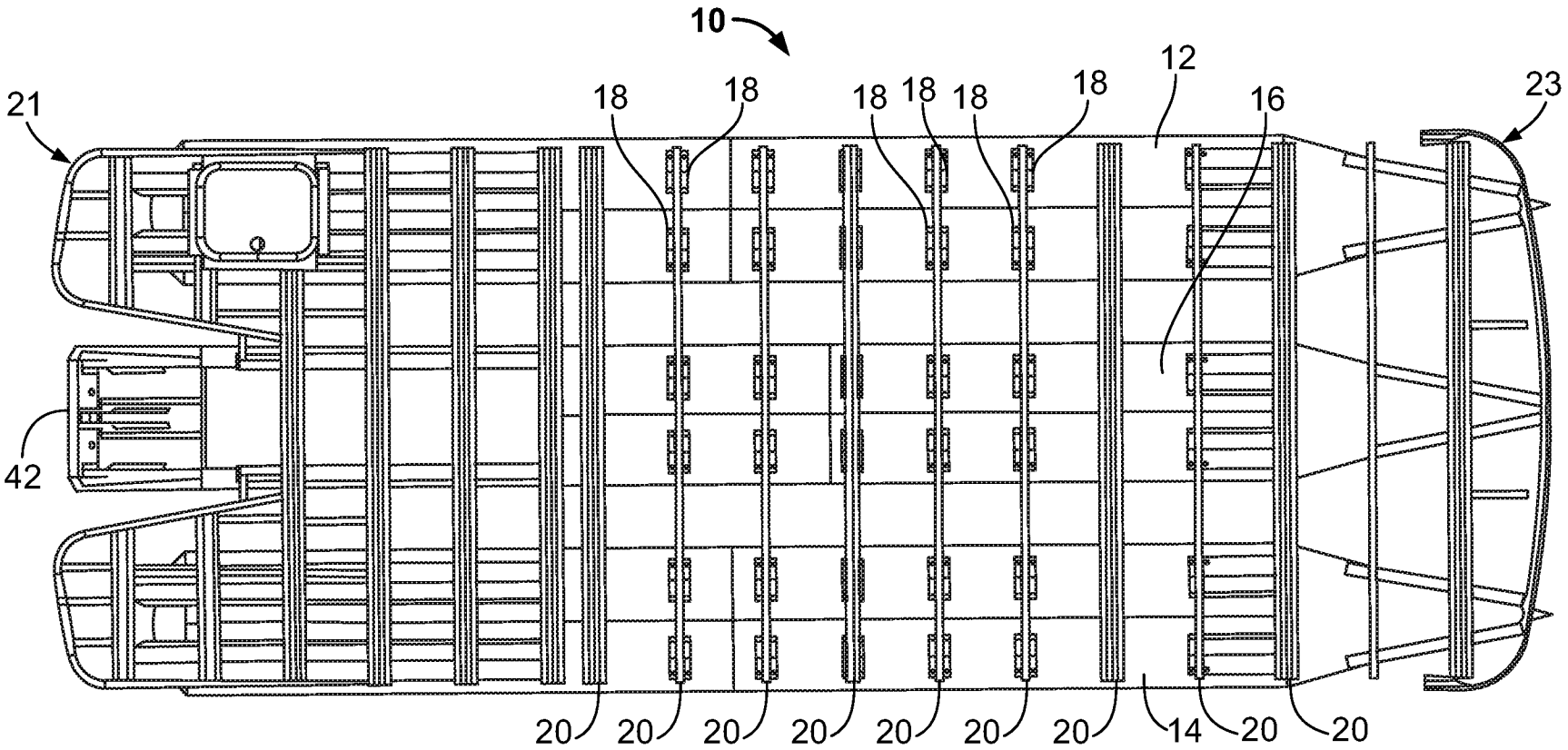
FIG. 2 is a top plan view of the structure of FIG. 1.

The drawings show a portion of an illustrative pontoon boat 10 according to the present disclosure including pontoons, cross members, and a rear frame thereof. More specifically, the boat 10 includes a first (or port) side pontoon 12, a second (or starboard) side pontoon 14 and a third (or center) pontoon 16, each having a plurality of risers 18 attached to upper portions thereof. The first, second, and third pontoons 12, 14, 16 are interconnected by a plurality of cross members 20*n*. The first, second, and third pontoons 12, 14, 16 also are interconnected by a rear frame 21 and by a forward frame 23 connected to corresponding ones of the risers 18. Each of the rear frame 21 and the forward frame 23 may include one or more cross members similar to the cross members 20*n*.

Each of the risers 18 is embodied as a platform 181 having first and second elongated legs 182, 183 extending therefrom. Each of the first and second elongated legs 182, 183 terminates in an elongated foot 184. Each of the feet 184 is attached to a corresponding one of the pontoons 12, 14, 16, for example, by welding, to a corresponding upper portion thereof. The several risers 18 are attached to the first, second, and third pontoons 12, 14, 16 in like locations so that upper surfaces of the respective platforms 181 cooperate to define a plane and so that the cross members 20*n* may be connected to the platforms 181 perpendicular to the pontoons and parallel to each other.

The cross members 20*n* are connected to the platforms 181 of the corresponding risers 18, for example, using mechanical fasteners, for examples, nuts and bolts, extending through corresponding apertures in the platforms of the risers and flanges of the cross members, as will be discussed further below. A shock absorber 22 is disposed between adjacent surfaces of the platform 181 of each riser 18 and the corresponding cross member 20*n*, the rear frame 21, and the forward frame 23. The shock absorbers 22 may be embodied as relatively thin members made of rubber or another flexible and resilient material, for example, neoprene, sanoprene or nitrile. For example, the shock absorbers 22 may be about ⅛"-½" thick, or thinner or thicker.

In an embodiment, each shock absorber 22 has an area that is substantially the entirety of the projection of the platform 181 of the riser onto the cross member 20*n* or of the cross member onto the platform, or a greater or lesser area. As such, the shock absorbers 22 provide flexible and resilient isolation and compliance between the riser platforms 181 and the cross members 20*n*. In an embodiment, a shock absorber 22 is provided at each and every point of connection of the cross members 20*n*, the rear frame 21, and the forward frame 23 to the risers 18 attached to each of the first, second and third pontoons 12, 14, 16. In another embodiment, a shock absorber 22 is provided at fewer than each and every point of connection of the cross members 20*n*, the rear frame 21, and the forward frame 23, to the risers 18 attached to each of the first, second and third pontoons 12, 14, 16.

Figure 9:
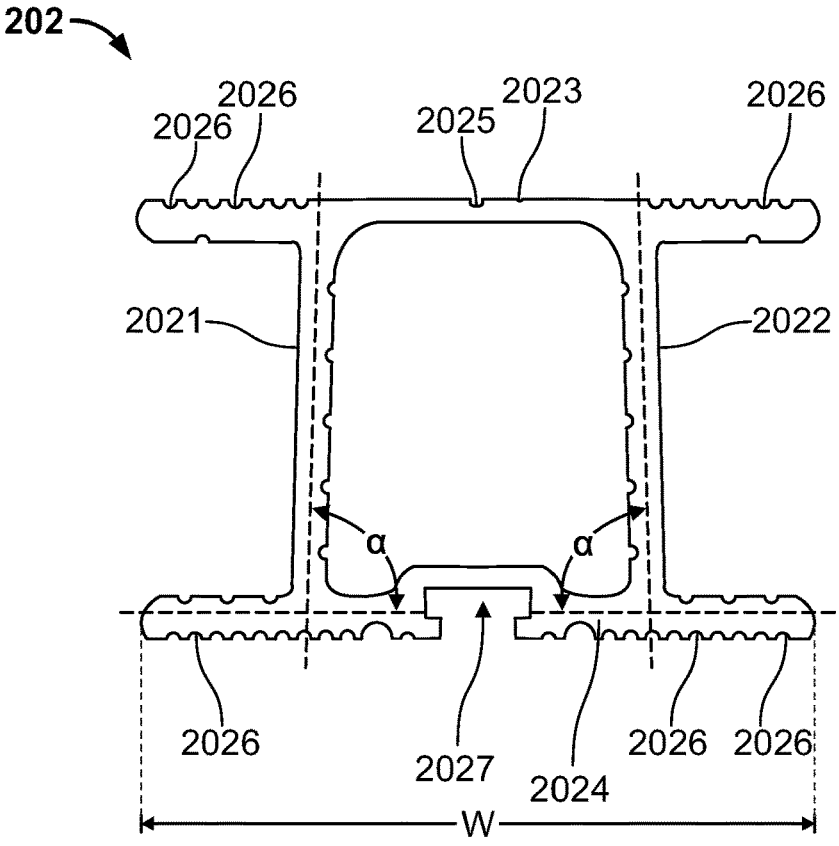
FIG. 9 is an end view of a first form of double-webbed cross member according to the present disclosure.
Figure 10:
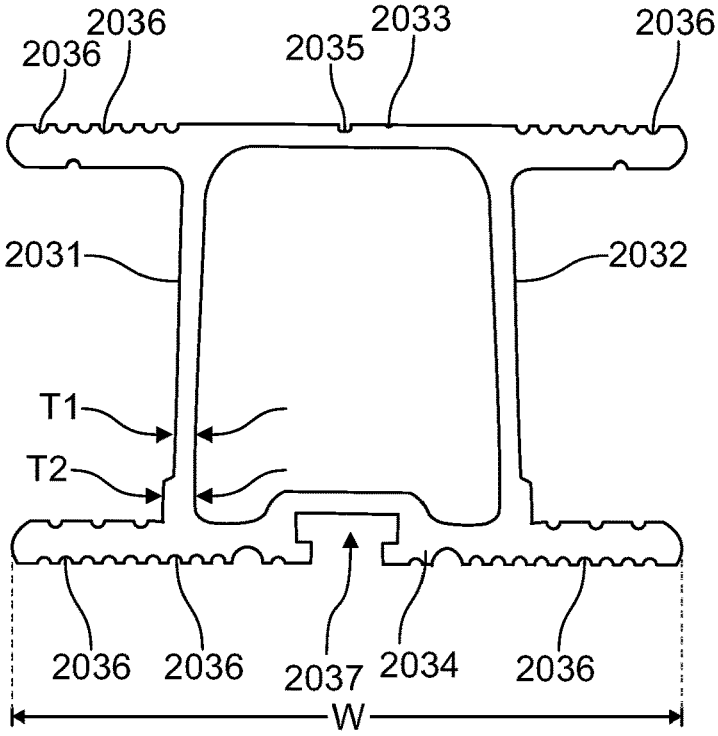
FIG. 10 is an end view of a second form of double-webbed cross member according to the present disclosure.

The various cross members 20*n* may take various forms. For example, in the illustrative embodiment shown, certain ones of the cross members 20*n* are embodied as C-channels 201. Certain other ones of the cross members 20*n* are embodied as a first form of double-webbed beam 202, as shown in FIG. 9. Certain further ones of the cross members 20*n* are embodied as a second form of double-webbed beam 203, as shown in FIG. 10.

Each of the cross members 20*n* embodied as a C-channel 201 may include a web 2011, a first flange 2013, and a second flange 2014.

As best shown in FIG. 9, each of the cross members 20*n* embodied as a first form of double-webbed beam 202 includes a first web 2021 having a first end and a second end, a second web 2022 having a first end and a second end, a first flange 2023 connecting the first ends of the first and second webs, and a second flange 2024 connecting the second ends of the first and second webs. The first and second webs 2021, 2022 are oriented at an angle $\alpha$ with respect to the second flange. In an embodiment, the angle $\alpha$ could be zero degrees. That is, the first and second webs 2021, 2022 could be parallel to each other.

In another embodiment, the angle $\alpha$ could be less than zero degrees, such that the first ends of the first and second webs 2021, 2022 are closer to each other than are the second ends thereof. For example, in an embodiment, the angle $\alpha$ may be about 88 degrees, or between 87 degrees and 89 degrees, or between about 86 degrees and about 90 degrees or between less than about 86 degrees and about 90 degrees. A double-webbed beam 202 thusly configured may have greater torsional stiffness than an otherwise similar beam having parallel webs.

The first and second webs 2021, 2022 of the double webbed beam 202 are of substantially uniform thickness from the respective ends thereof to the respective second ends thereof. The first and second flanges 2023, 2024 are parallel to each other. Each of the flanges 2023, 2024 is about the same width W, which width is substantially greater than distance between respective ends of the first and second webs 2021, 2022. As such, the portion of each of the first and second flanges 2023, 2024 outboard of the first and second webs 2021, 2022 defines an area at least great enough to receive a fastener therethrough in secure structural engagement, as will be discussed further below.

The outwardly-facing surface of the first flange 2023 defines a plurality of elongated, longitudinally extending grooves. One of the grooves 2025 is a center groove disposed along the longitudinal centerline of the first flange. This center groove 2025 may be used during construction of the pontoon boat 10 as a gauge of squareness or trueness of the cross members 20*n* with respect to the first, second, and third pontoons 12, 14, 16 and/or squareness or trueness of the cross members 20*n* with respect to deck boards connected thereto.

Others of the grooves defined by the first flange 2023 are outboard grooves 2026 disposed outboard of the respective first ends of the first and second webs 2021, 2022. The outboard grooves 2026 may receive adhesive, caulk, or the like between the first flanges and deck boards connected thereto.

The outwardly-facing surface of the second flange 2024 similarly defines a plurality of elongated outboard grooves 2026 disposed inboard or outboard or both inboard and outboard of the respective first ends of the first and second webs 2021, 2022. These outboard grooves 2026 may receive adhesive, caulk, or the like between the second flanges 2024 and corresponding risers 18 or intervening shock absorbers 22 connected thereto.

The second flange 2024 further defines an elongated T-shaped slot 2027 configured to receive a head of a T-bolt 21 in sliding engagement therein. The T-bolt 21 may be used to secure the cross member 202 to a corresponding riser 18.

The second form of double-webbed cross member 203 is similar to the first form of double-webbed cross member 202, and like features thereof are identified in the drawings using like reference numbers, incremented by ten. As best shown in FIG. 10, the second form of double-webbed cross member 203 differs from the first form of double-webbed cross member 202 in that the first and second webs 2031, 2032 of the cross member 203 have a non-uniform thickness from the first end thereof to the second end thereof. More specifically, the first and second webs 2031, 2032 of the cross member 203 have a first thickness T1 proximate the first ends thereof and a second thickness T2 proximate the second ends thereof, the second thickness T2 being substantially greater than the first thickness T2 thereof. For example, the second thickness T2 may be about 150% of the first thickness T1, or any thickness between about 125% to about 175% of the first thickness T1, or any thickness between about 105% of the first thickness and about 195% of the first thickness T1. The respective thicknesses of the first and second webs 2031, 2032 may vary continuously from proximate the respective first ends thereof to proximate the respective second ends thereof or through one or more steps. In embodiments wherein the foregoing thicknesses vary in steps, the step changes in thickness may be proximate the respective first ends of the webs 2031, 2032, proximate the respective second ends thereof, or at any point intermediate the first and second ends thereof.

In an embodiment, the C-channel cross members 201 may be used in locations wherein torsional and other stresses placed thereon during normal operation of the pontoon boat 10 are expected to be relatively low, for example, near the bow of the boat. The first form of double-webbed cross members 202 may be used in locations wherein torsional and other stresses are expected to be relatively high, for example, near the stern of the boat and/or underlying joints between adjacent deck boards, as will be discussed further below. The second form of double-webbed cross members 203 may be used in locations wherein torsional and other stresses are expected to be relatively low and underlying joints between adjacent deck boards. Use of either form of double-webbed cross member 202, 203 at locations underlying joints between adjacent deck boards may facilitate connection of the deck boards to the cross members.

Figure 11:
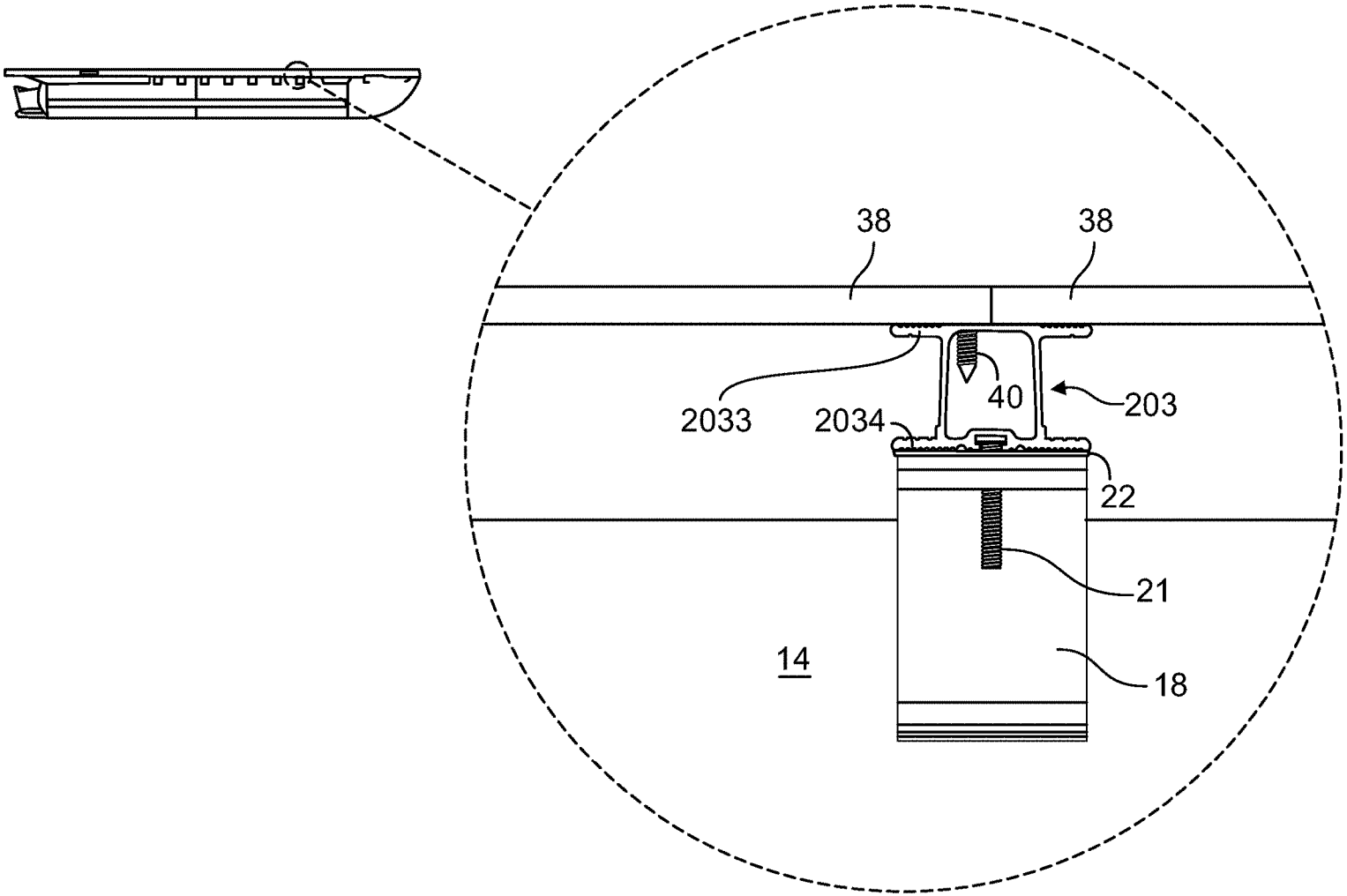
FIG. 11 is a side elevation detail view of deck boards connected to the cross member of FIG. 10, in turn connected to a pontoon through an intervening riser and shock absorber according to the present disclosure.
Figure 12:
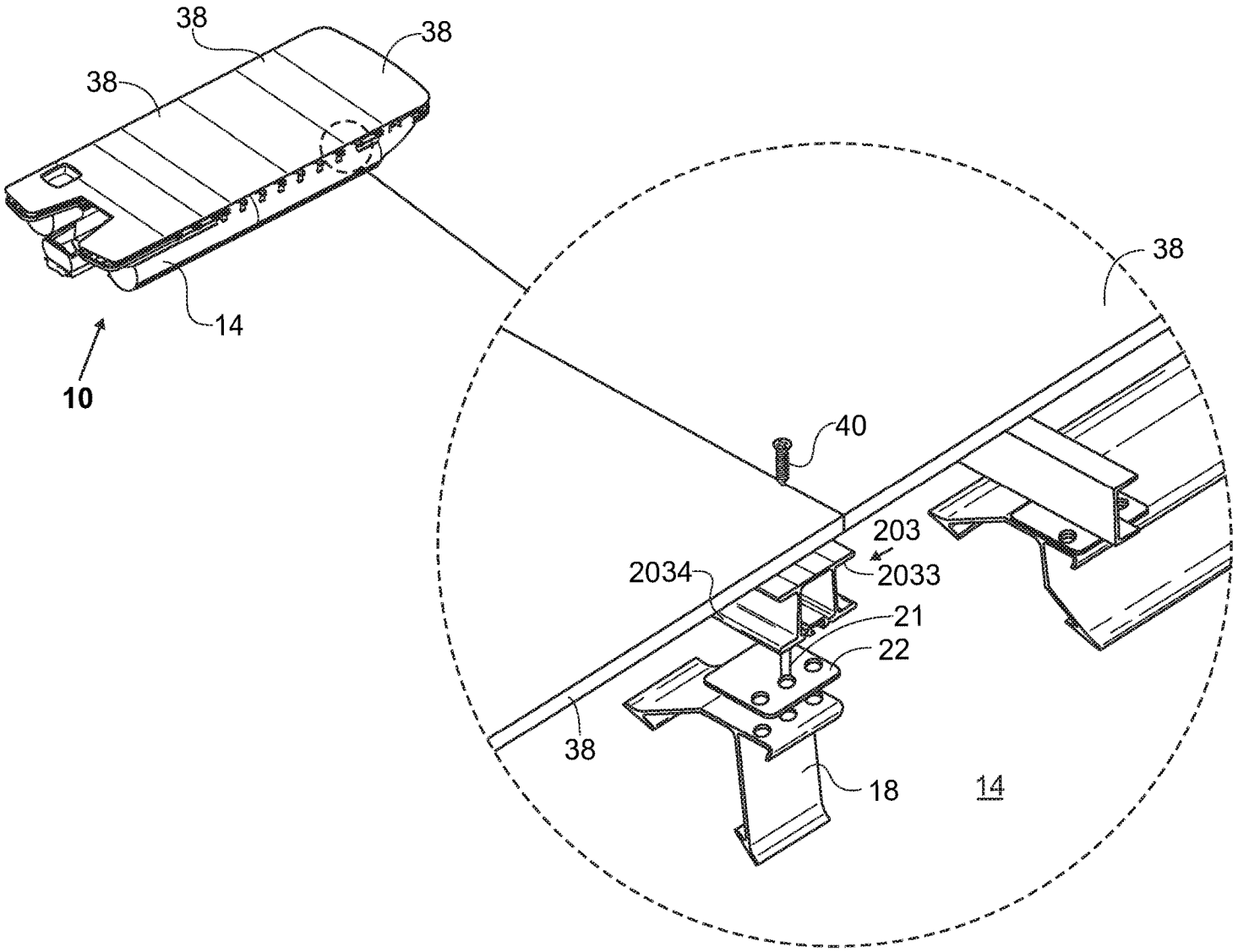
FIG. 12 is an exploded detail perspective view of the assembly of FIG. 12.

As suggested above, and with reference to FIGS. 11 and 12, deck boards 38 overlie the cross members 20*n* and may be connected thereto, for example, using self-tapping or other screws 40 driven through the deck boards and into the first flanges 2013, 2023, 2033 of the underlying cross members 201, 202, 203. The first flanges 2013 of the C-channels 201 typically have sufficient area to readily receive such a screw. The first flanges 2013 of the C-channels 201, however, typically lack sufficient area to readily receive screws fastening respective ends of abutting or adjacent deck boards 38 thereto, with the screws driven in perpendicular to the deck boards and flanges. As such, such screws would need to be driven through the deck boards 38 and flange diagonally. Such an operation is relatively difficult and time consuming, and it requires relatively great precision compared to driving a screw perpendicular to a deck board and underlying flange.

The respective first flanges 2023, 2033 of the first and second forms of double-webbed cross members 202, 203 have substantially greater surface area than the first flange 2013 of the C-channel cross member 201. This feature enables driving screws fastening respective ends of abutting or adjacent deck boards 38 thereto perpendicular to the deck boards and flanges, rather than diagonally with respect thereto.

As shown, the cross members 202, 203 may be installed to the risers 18 with the respective second flanges 2024, 2034 thereof adjacent the risers 18 and the respective first flanges 2023, 2033 distant from the risers (and underlying the deck boards).

Each of the first, second, and third pontoons 12, 14, 16 defines a corresponding longitudinal axis A1 wherein the corresponding axes A1 are substantially parallel to each other. The respective front ends of the first, second, and third pontoons 12, 14, 16 may be, but need not be, substantially aligned.

The first pontoon 12 includes a first (or nose) portion 121, a second (or center) portion 122, and a third (or rear) portion 123. The nose portion 121 tapers from a generally cylindrical profile proximate an aft end thereof to a point proximate a foremost and uppermost portion thereof. The center portion 122 has a generally cylindrical profile from a front end thereof to an aft end thereof. The rear portion 122 has a domed shape.

Figure 4:
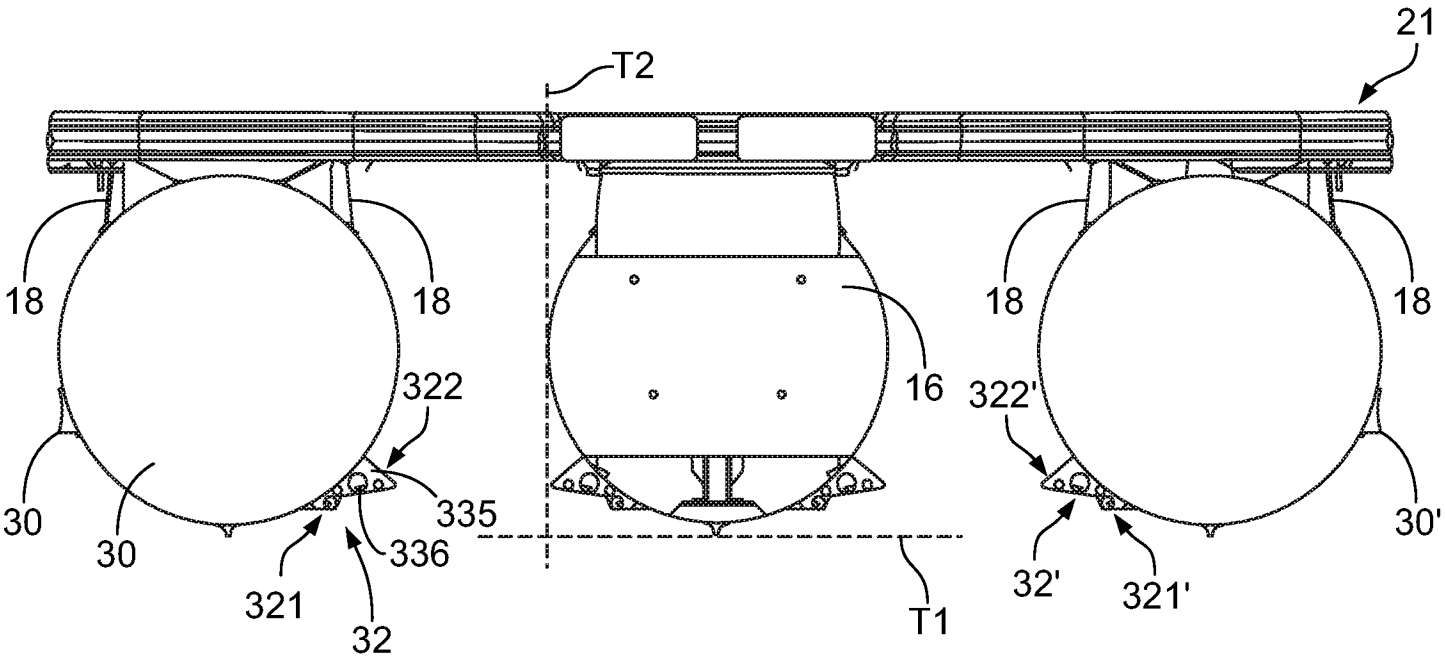
FIG. 4 is a rear elevation view of the structure of FIG. 1.
Figure 5:
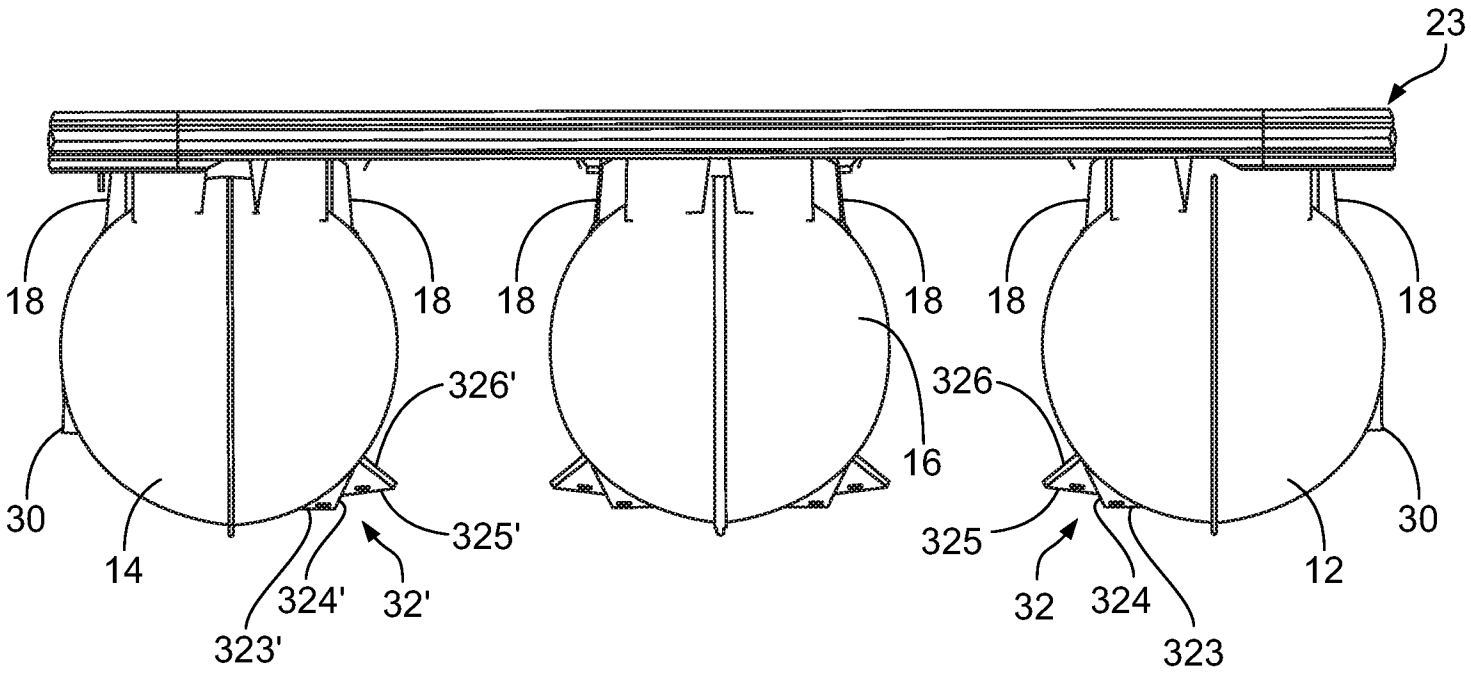
FIG. 5 is a front elevation view of the structure of FIG. 1.
Figure 6:
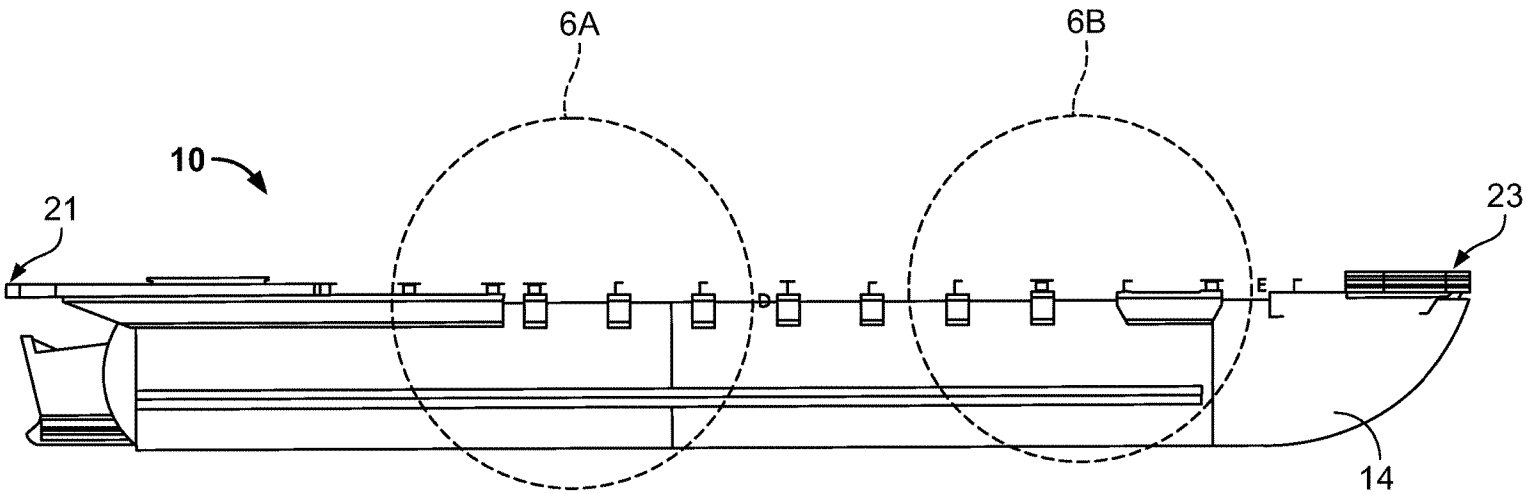
FIG. 6 is a starboard side elevation view of the structure of FIG. 1.
Figure 6B:
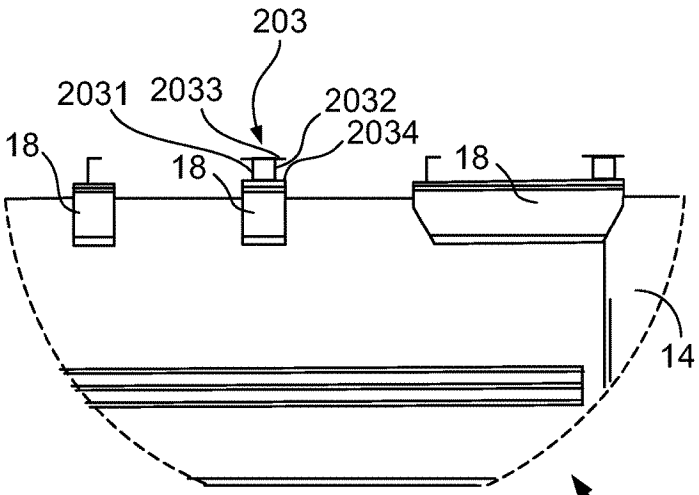
FIG. 6B is a detail view of another portion of the structure as shown in FIG. 6.
Figure 6A:
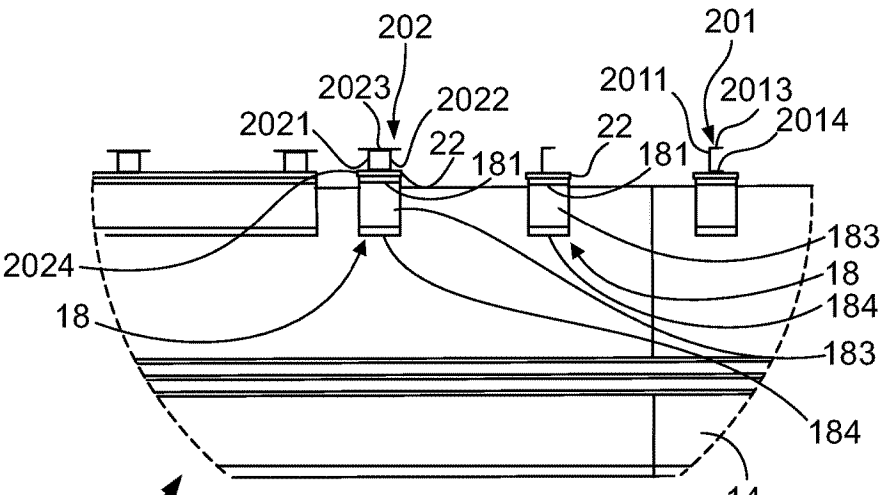
FIG. 6A is a detail view of a portion of the structure as shown in FIG. 6.
Figure 7:
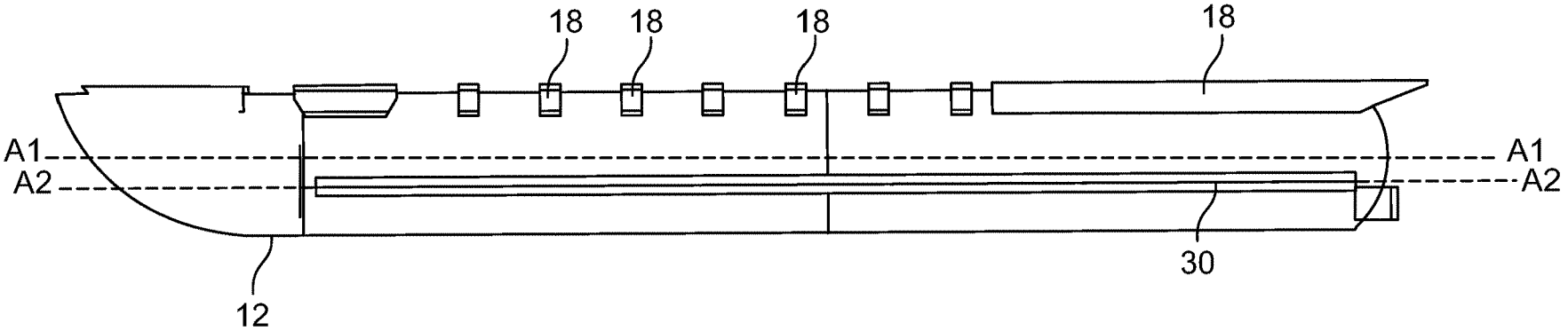
FIG. 7 is a port side view of the port pontoon of the structure of FIG. 1.
Figure 8:
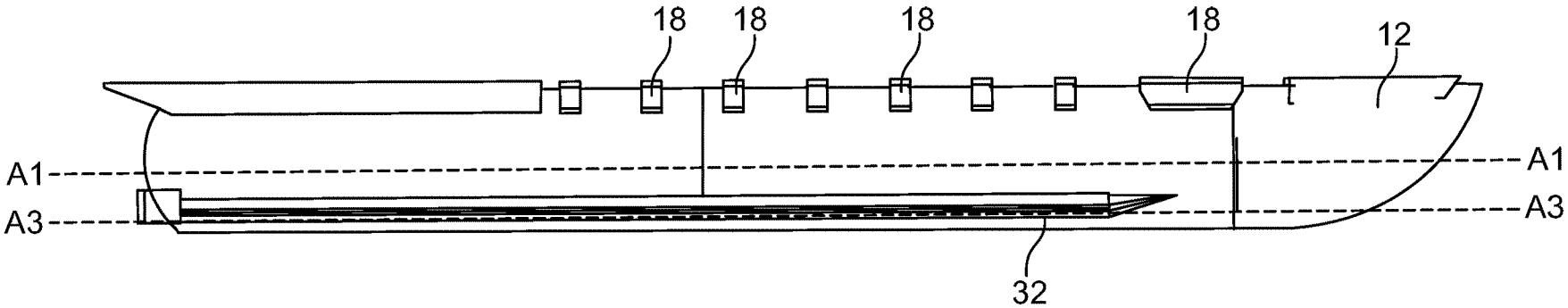
FIG. 8 is a starboard side view of the port pontoon of FIG. 6.

A first lifting strake 30 is attached to an outboard portion of the first pontoon 12, nearer the horizontal center of the first pontoon than to the bottom thereof. The first lifting strake extends from proximate the foremost end of the center portion 122 thereof to proximate the aft end of the center portion thereof. As best shown in FIGS. 4 and 5, the first lifting strake 30 has a generally triangular profile, for example, a right triangular profile. The first lifting strake 30 defines a longitudinal axis A2 generally parallel to the longitudinal axis A1 of the first pontoon 12. In an embodiment, the axis A2 could be other than parallel to the axis A1.

A second lifting strake 32 is attached to an inboard portion of the first pontoon 12, near the bottom thereof. In other embodiments, the second lifting strake 32 is attached to the inboard portion of the first pontoon 12 at any desired location between the bottom and the midpoint thereof or above the midpoint thereof. The second lifting strake 32 extends from proximate the foremost end of the center portion 122 thereof to proximate the aft end of the center portion thereof. The second lifting strake 32 has a complex profile generally defining a first triangular portion 321 and a second triangular portion 322 when viewed from either end thereof.

Figure 13:
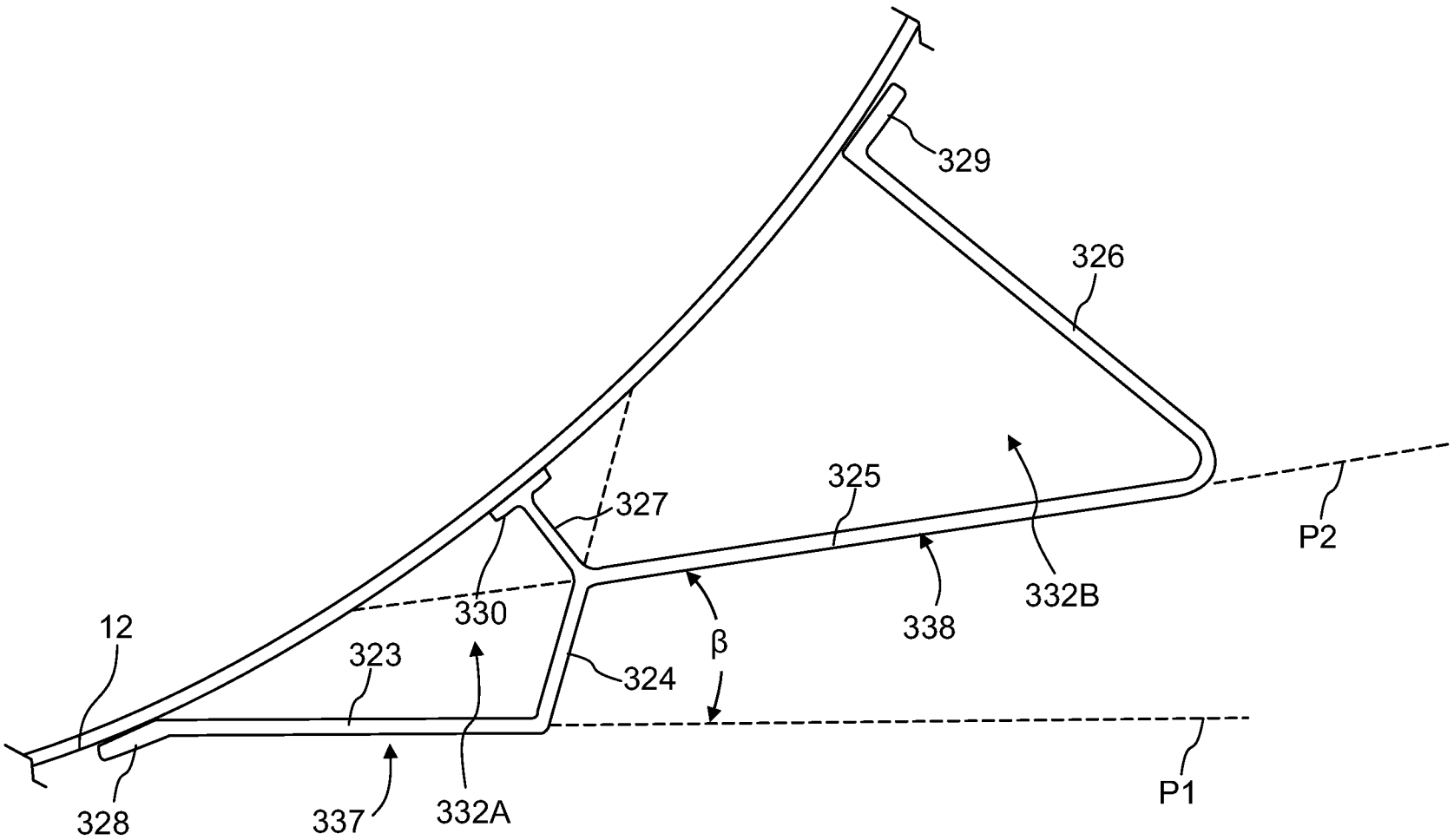
FIG. 13 is an end view of a lifting strake according to the present disclosure.

As best shown in FIG. 13, the second lifting strake 32 includes a first flange 323, a second flange 324 connected to the first flange, a third flange 325 connected to the second flange, a fourth flange 326 connected to the third flange, and a fifth flange 327 connected to the second and third flanges where the second and third flange are connected to each other. Each of the first, fourth, and fifth flanges 323, 326, 327 terminates in a respective elongated foot 328, 329, 330 at the respective free end thereof.

Each of the feet 328, 329 is attached, for example, by welding, to the surface of the first pontoon 12. With the second lifting strake 32 thus attached to the first pontoon 12, the foot 330 abuts the surface of the first pontoon, thereby precluding the second lifting strake 32 from collapsing against the first pontoon 12. In an embodiment, the foot 330 may be spaced a predetermined, non-zero distance from the first pontoon 12 when the second lifting strake 32 is attached to the first pontoon as described above, thereby allowing some flexing of the second lifting strake with respect to the first pontoon, but inhibiting collapse of the second lifting strake with respect to the first pontoon.

The second lifting strake 32 defines a longitudinal axis A3 generally parallel to the longitudinal axis A1 of the first pontoon 12. In an embodiment, the axis A3 could deviate slightly from parallel to the axis A1.

The first flange 323 defines a first plane P1 generally parallel to the horizontal (or to a tangent defined by the lowermost portion of the first pontoon 12) when the boat 10 is upright and level. (For clarity, an analogous tangent T1 is shown with respect to the third pontoon 16 in FIG. 4.) The second flange 325 defines a second plane P2 inclined upwardly from the first plane P1 at an angle β. The angle β may be selected as desired to achieve a particular handling characteristic of the pontoon boat 10 during normal operation thereof. For example, with the second flange 325 set at an angle β of about zero degrees, the pontoon boat 10 will tend to ride higher in the water and turn more slowly in response to a given steering input than it would with the second flange 325 set at a greater angle β. As the angle β increases from zero degrees, the pontoon boat 10 will tend to ride lower in the water and turn more quickly in response to a given steering input than it would with the second flange 325 set at an angle β nearer to zero degrees, all other factors being equal.

As shown, the angle β may be about seven degrees. In other embodiments, the angle β may be a lesser or greater angle, for example, any angle between about six degrees and about eight degrees, or between about four degrees and about ten degrees, or between about zero degrees and about twelve degrees, or between about minus twenty degrees and about twenty degrees. As the angle β decreases from zero degrees, the second flange 325 may act as a keel, moving water so that the pontoon boat 10 will tend to turn more slowly in response to a given steering input than it would with the second flange 325 set at an angle β nearer to zero degrees, all other factors being equal.

In an embodiment, the second lifting strake 32 does not extend laterally beyond a tangent defined by the starboard-most extent of the first pontoon 12. (For clarity, an analogous tangent T2 is shown with respect to the port-most extent of the third pontoon 16.) In another embodiment, the second lifting strake 32 may extend laterally beyond the foregoing tangent. In such an embodiment, the portion of the second lifting strake 32 extend laterally beyond the foregoing tangent may interfere with the loading of the pontoon boat 10 onto a trailer.

As shown in FIG. 13, the surface area of the third flange 325 of the second lifting strake 32 may be vary substantially from the surface area of the first flange 323 of the second lifting strake. For example, the surface area of the third flange 325 of the second lifting strake 32 may be about twice the surface area of the first flange 323 of the second lifting strake. In other embodiments, the surface area ratio of the surface area of the third flange 325 to the surface area of the first flange 323 may be selected as desired. For example, the foregoing surface area ratio may be selected to be about one or lesser or greater than one. Generally, the higher the foregoing surface area ratio, the lower the pontoon boat 10 will ride in the water, and the more quickly the pontoon boat will respond to a given steering input, all other factors being equal. Conversely, the lower the foregoing surface area ratio, the higher the pontoon boat 10 will ride in the water, and the more slowly the pontoon boat will respond to a given steering input, all other factors being equal.

A nose cone 331 is provided at the forward end of the second lifting strake 32. The nose cone 331 has an aft end and a forward end. The aft end has a cross section identical or substantially similar to the profile of the forward end of the second lifting strake 32. The cross section of the nose cone 331 tapers from the foregoing profile at the aft end thereof to a point at the forward end thereof.

Figure 3:
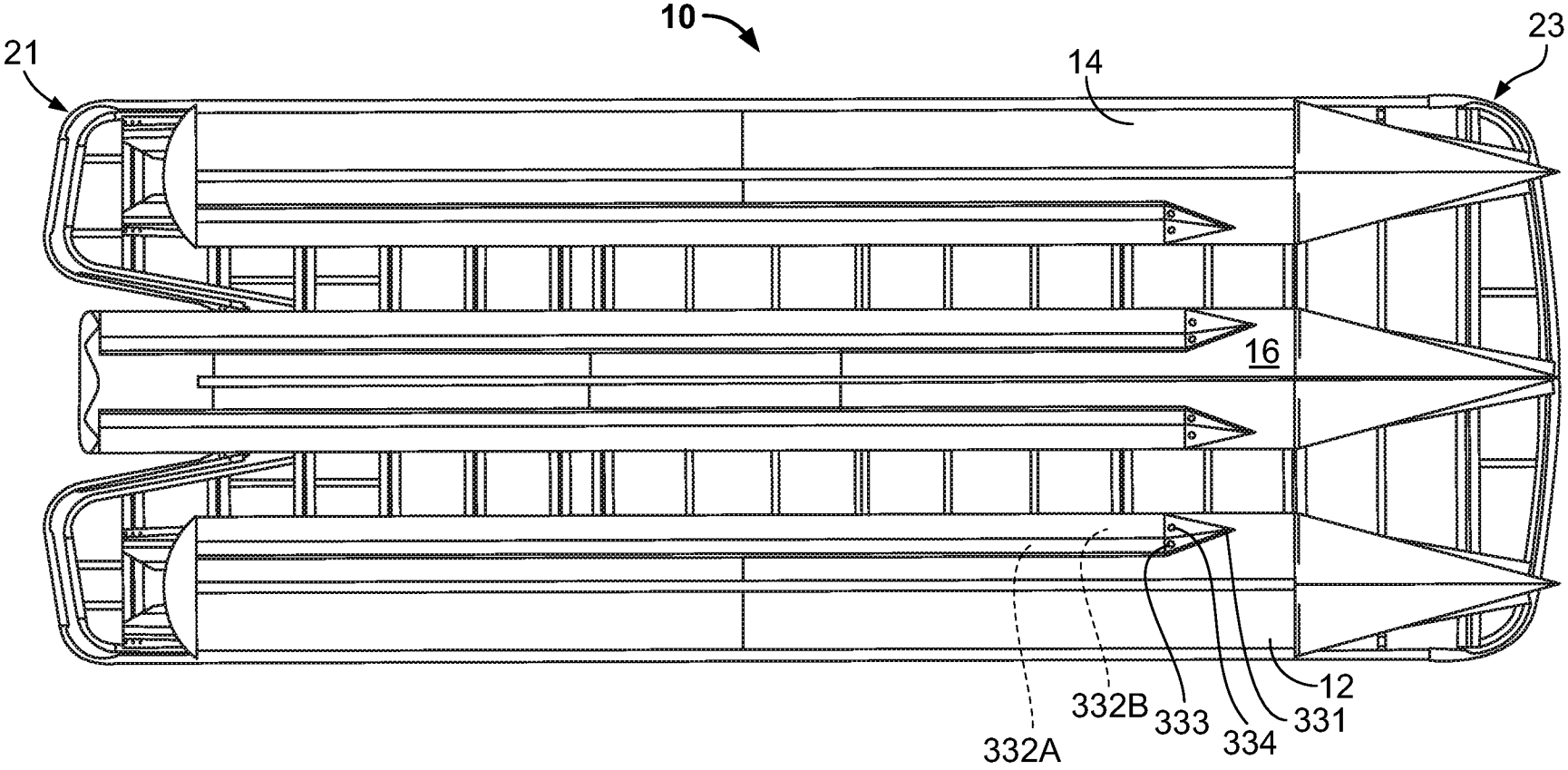
FIG. 3 is a bottom plan view of the structure of FIG. 1.

The second lifting strake 32 and the adjacent outer surface of the first pontoon 12 cooperate to define a first interior space 332A and a second interior space 332B. As best shown in FIG. 3, a lower surface of the nose cone 331 defines a first port 333, and another lower surface of the nose cone defines a second port 334. Each of the first port 333 and the second port 334 is configured to allow fluid communication between the respective interior space 332A, 332B and the environment about the first pontoon 12 and the second lifting strake 32. Either or both of the first and second ports 333, 334 may be provided with a threaded insert configured for threaded engagement with a complementary plug or an end of a hose. Such a plug (not shown) could be installed in the respective port 333, 334 to inhibit flow of water through the first and second interior spaces 332A, 332B during use of the boat 10. The plug could be removed to facilitate draining of water that may have accumulated within the first and second interior spaces 332A, 332B when the boat 10 is removed from the water. The treaded insert may further be configured to for threaded engagement with an end of a garden hose that may be used to flush the first and second interior spaces 332A, 332B, for example, to remove invasive species that may have accumulated there during use of the boat 10.

As best shown in FIG. 4, an end cap 335 is attached to the aft end of the second lifting strake 32. The end cap may define one or more apertures 336 allowing fluid communication between the interior spaces 332A, 332B and the environment about the first pontoon 12 and the second lifting strake 32. The ports 333, 334 and the apertures 336 in the end cap 335 cooperate to selectively drain water that may otherwise accumulate in the interior spaces 332A, 332B.

The second pontoon 14 is equipped with third and fourth lifting strakes 30', 32' analogous to the first and second lifting strakes 30, 32 in an analogous, mirror image manner.

The third pontoon 16 is equipped with fifth and sixth lifting strakes 34, 36 analogous to the second and fourth lifting strakes second 32, 32'.

In an embodiment, the fifth and sixth lifting strakes 34, 36 could be omitted from the third pontoon 16. In another embodiment, the second lifting strakes 32, 32' could be omitted from the first and second pontoons 12, 14. In a further embodiment, the third pontoon 16 could be omitted.

As shown, a motor pod 42 is attached the aft end of the center pontoon 16. In embodiments not including a center pontoon (not shown), a motor pan similar to the motor pod 42 may be connected to a rear portion of the frame of the pontoon boat 10.

References to orientation (for example, upper, lower, front, back, left, right, and the like) herein should be construed in a relative, rather than absolute, sense, unless context clearly dictates otherwise. The disclosure sets forth certain illustrative embodiments of a pontoon boat. Not all features need be incorporated into every embodiment, and features disclosed in connection with a given embodiment may be incorporated into any other embodiment to the greatest extent possible without departure from the scope of the invention, which is defined solely by the appended claims.

The invention claimed is:

1. A pontoon boat comprising:

a first pontoon having a first longitudinal axis;

a second pontoon having a second longitudinal axis parallel to the first longitudinal axis;

a plurality of cross members, each of the plurality of cross members connected to the first pontoon and to the second pontoon at a plurality of points of connection; and a plurality of shock absorbing members, a respective one of the plurality of shock absorbing members disposed between the respective cross member and the respective one of the first pontoon and the second pontoon at each of the plurality of points of connection.

2. The pontoon boat of claim 1 further comprising a first plurality of risers connected to the first pontoon and a second plurality of risers connected to the second pontoon, the plurality of points of connection comprising the first plurality of risers and the second plurality of risers.

3. The pontoon boat of claim 1, each of the plurality of shock absorbing members comprising a member made of a flexible and resilient material.

4. The pontoon boat of claim 3, the flexible and resilient material comprising rubber, neoprene, sanoprene or nitrile.

5. The pontoon boat of claim 3, each of the first and second pluralities of risers comprising a platform, and each of the shock absorbing members having an area that is substantially the entirety of a projection of the platform of the riser onto the corresponding cross member.

6. The pontoon boat of claim 5, wherein each of the shock absorbing members is thin with respect to its area.

7. A pontoon boat comprising:

a first pontoon having a first longitudinal axis;

a second pontoon having a second longitudinal axis parallel to the first longitudinal axis;

a plurality of cross members, each of the plurality of cross members connected to the first pontoon at a respective first point of connection and to the second pontoon at a respective second point of connection; and a plurality of shock absorbing members, respective ones of the plurality of shock absorbing members disposed between respective ones of the plurality of cross members and the first pontoon at respective ones of the first points of connection and between respective ones of the plurality of cross members and the second pontoon at respective ones of the second points of connection.

8. The pontoon boat of claim 7 further comprising a first plurality of risers connected to the first pontoon and a second plurality of risers connected to the second pontoon, each of the first points of connection and second points of connection comprising respective ones of the first plurality of risers and the second plurality of risers.

9. The pontoon boat of claim 8, each of the plurality of shock absorbing members comprising a member made of a flexible and resilient material.

10. The pontoon boat of claim 9, the flexible and resilient material comprising rubber, neoprene, sanoprene or nitrile.

11. The pontoon boat of claim 9, each of the first and second pluralities of risers comprising a platform, and each of the shock absorbing members having an area that is substantially the entirety of a projection of the platform onto the corresponding cross member.

12. The pontoon boat of claim 7, each of the plurality of shock absorbing members comprising a member made of a flexible and resilient material.

13. The pontoon boat of claim 12, each of the plurality of the plurality of cross members further connected to the first pontoon at a respective third point of connection, and respective ones of the plurality of shock absorbing members disposed between respective ones of the plurality of cross members and the first pontoon at respective ones of the third points of connection.

14. The pontoon boat of claim 13, each of the plurality of cross members further connected to the second pontoon at a respective fourth point of connection, and respective ones of the plurality of shock absorbing members disposed between respective ones of the plurality of cross members and the second pontoon at respective ones of the fourth points of connection.

15. A pontoon boat comprising:

a first pontoon having a first longitudinal axis;

a second pontoon having a second longitudinal axis parallel to the first longitudinal axis;

a plurality of cross members, each of the plurality of cross members connected to the first pontoon at a respective first point of connection, to the second pontoon at a respective second point of connection, to the first pontoon at a respective third point of connection, and to the second pontoon at a respective fourth point of connection; and a plurality of shock absorbing members, respective ones of the plurality of shock absorbing members disposed between respective ones of the plurality of cross members and the first pontoon at respective ones of the first points of connection and between respective ones of the plurality of cross members and the second pontoon at respective ones of the second points of connection.

16. The pontoon boat of claim 15, each of the plurality of shock absorbing members comprising a member made of a flexible and resilient material.

17. The pontoon boat of claim 16 further comprising a first plurality of risers connecting respective ones of the plurality of cross members to the first pontoon at respective ones of the first points of connection, a second plurality of risers connecting respective ones of the plurality of cross members to the second pontoon at respective ones of the second points of connection, a third plurality of risers connecting respective ones of the plurality of cross members to the first pontoon at respective ones of the third points of connection, and a fourth plurality of riser connecting respective ones of the plurality of cross members to the second pontoon at respective ones of the fourth points of connection.

18. The pontoon boat of claim 17, each of the first, second, third, and fourth pluralities of risers comprising a respective platform, and each of the shock absorbing members having an area that is substantially the entirety of a projection of the platform onto the corresponding cross member.

19. The pontoon boat of claim 18 wherein each of the shock absorbing members is thin with respect to its area.

20. The pontoon boat of claim 19 wherein at least one of the first points of connection comprises a bolted connection.

21. The pontoon boat of claim 20 wherein the bolted connection comprises a bolt extending through the first pontoon and the respective one of the first plurality of risers and the respective one of the plurality of shock absorbing members.

* * * * *